US012090540B2

(12) United States Patent
Bauer et al.

(10) Patent No.: US 12,090,540 B2
(45) Date of Patent: Sep. 17, 2024

(54) DEVICE AND METHOD FOR SHAPING SHEET METAL

(71) Applicant: Bayerische Motoren Werke Aktiengesellschaft, Munich (DE)

(72) Inventors: Frank-Andreas Bauer, Gauting (DE); Robert Naeb, Freising (DE); Rena Pech, Leipzig ot Baalsdorf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/442,625

(22) Filed: Jun. 17, 2019

(65) Prior Publication Data

US 2019/0299265 A1 Oct. 3, 2019

Related U.S. Application Data

(63) Continuation of application No. PCT/EP2017/079532, filed on Nov. 17, 2017.

(30) Foreign Application Priority Data

Dec. 22, 2016 (DE) ..... 10 2016 225 986.5

(51) Int. Cl.
*B21D 11/20* (2006.01)
*B21D 5/00* (2006.01)
*B21D 31/00* (2006.01)

(52) U.S. Cl.
CPC ..... *B21D 11/20* (2013.01); *B21D 5/004* (2013.01); *B21D 31/005* (2013.01)

(58) Field of Classification Search
CPC ..... B21D 11/20; B21D 11/06; B21D 11/22; B21D 5/004; B21D 5/00; B21D 5/01;
(Continued)

(56) References Cited

U.S. PATENT DOCUMENTS 4,212,188 A * 7/1980 Pinson ..... B21D 5/01 72/413
5,187,969 A * 2/1993 Morita ..... B21D 53/886 72/413

(Continued)

FOREIGN PATENT DOCUMENTS

CN 1787888 A 6/2006
CN 101712054 A 5/2010

(Continued)

OTHER PUBLICATIONS

JP 60-145224A, Japan, Jul. 1985.*

(Continued)

*Primary Examiner* — Edward T Tolan
(74) *Attorney, Agent, or Firm* — Crowell & Moring LLP

(57) ABSTRACT

A device and a method are provided for shaping sheet metal. The device is provided with a plurality of support and clamping elements which are designed to cooperate with one another so as to clamp the sheet metal for a shaping process by mechanically contacting the sheet metal and by holding, orienting, and/or positioning processes. A plurality of actuators are designed to orient and/or position the plurality of support and clamping elements. A controller for the actuators is designed to control the plurality of actuators for adjusting the orientation and/or position of the support and clamping elements.

4 Claims, 2 Drawing Sheets

(58) Field of Classification Search
CPC ..... B21D 5/04; B21D 5/002; B21D 31/005; B21D 24/10; B21D 43/021; B21D 1/14; B21D 1/145; G05B 2219/45143; B23Q 15/22
USPC ..... 72/306, 307
See application file for complete search history.

(56) References Cited

U.S. PATENT DOCUMENTS

| | | | | |
|---|---|---|---|---|
| 5,471,856 | A * | 12/1995 | Suzuki | B21D 7/06 72/1 |
| 5,546,784 | A * | 8/1996 | Haas | B21D 37/02 72/413 |
| 6,012,314 | A * | 1/2000 | Sullivan | G05B 19/414 72/14.8 |
| 6,089,061 | A * | 7/2000 | Haas | B21D 37/16 72/14.8 |
| 6,578,399 | B1 * | 6/2003 | Haas | B21D 22/10 72/342.1 |
| 8,298,242 | B2 * | 10/2012 | Justis | A61B 17/8863 72/413 |
| 9,789,526 | B2 * | 10/2017 | Kozaki | B21D 43/003 |
| 9,963,978 | B2 * | 5/2018 | Johnson | B29C 70/525 |
| 10,124,546 | B2 * | 11/2018 | Johnson | B29C 51/264 |
| 2007/0266752 | A1 | 11/2007 | Patuzzi et al. | |
| 2011/0046783 | A1 * | 2/2011 | Benchikh | B25J 9/1671 700/254 |

FOREIGN PATENT DOCUMENTS

| | | | |
|---|---|---|---|
| CN | 105013939 | A | 11/2015 |
| DE | 24 02 190 | A1 | 7/1975 |
| DE | 199 21 176 | A1 | 11/2000 |
| DE | 100 43 209 | A1 | 4/2002 |
| DE | 20 2005 013 912 | U1 | 12/2005 |
| EP | 2 077 166 | A1 | 7/2009 |
| JP | 2010-194599 | A | 9/2010 |

OTHER PUBLICATIONS

Translation JP 60-145224A, Japan Jul. 1985.*
KR 101606325A, Kang et al. Mar. 2016.*
Chinese-language Office Action issued in counterpart Chinese Application No. 201780060440.8 dated Dec. 13, 2019 with English translation (nine (9) pages).
International Search Report (PCT/ISA/210) issued in PCT Application No. PCT/EP2017/079532 dated Feb. 22, 2018 with English translation (four (4) pages).
German-language Written Opinion (PCT/ISA/237) issued in PCT Application No. PCT/EP2017/079532 dated Feb. 22, 2018 (five (5) pages).
German-language Search Report issued in counterpart German Application No. 102016225986.5 dated Nov. 3, 2017 with partial English translation (12 pages).

* cited by examiner

DEVICE AND METHOD FOR SHAPING SHEET METAL

CROSS REFERENCE TO RELATED APPLICATIONS

This application is a continuation of PCT International Application No. PCT/EP2017/079532, filed Nov. 17, 2017, which claims priority under 35 U.S.C. § 119 from German Patent Application No. 10 2016 225 986.5, filed Dec. 22, 2016, the entire disclosures of which are herein expressly incorporated by reference.

BACKGROUND AND SUMMARY OF THE INVENTION

The present invention relates to a device and a method for shaping a metal sheet, in particular a bodywork or a bodywork component.

When chassis or bodywork components are produced, sheet metal components are subjected to specific shaping processes. In mass production, compliance with dimensions is of significant importance. Until now, in the production method, deviations in the corresponding clamping devices for the metal sheets are corrected manually by means of dimensional verification in the current production process. This is carried out, for example, by means of manual adjustment, where applicable using so-called shim plates which are fitted to the support or clamping regions or locations of the tools in order to bring about a dimension correction.

It is disadvantageous in this instance that no central and derivative-specific geometry adaptation is possible and a documentation of the manual measures carried out is difficult since it is time-consuming and prone to errors.

An object of the invention is to provide a device and a method for shaping a metal sheet which reliably enable, with little complexity, a correction during the production.

The object according to the invention is achieved with a device for shaping a metal sheet, and with a method for shaping a metal sheet, in accordance with embodiments of the invention.

According to a first aspect of the present invention, there is provided a device for shaping a metal sheet which is constructed having a plurality of support and clamping elements which are configured in cooperation to clamp the metal sheet for a shaping operation in mechanical contact with the metal sheet and by way of retention, orientation and/or positioning processes. A plurality of actuators are configured to orientate and/or position the plurality of support and clamping elements. A control device for the actuators is configured to control the plurality of actuators for an adjustment correction of the orientation and/or position of the support and clamping elements.

As a result of the measures provided according to the invention, via the control device depending on requirements, the actuators and consequently the individual support and clamping elements can be adjusted for subsequent adjustment without manual intervention. This can be carried out automatically, wherein any adjustment measures can also be logged at the same time. This simplifies the handling and prevents errors.

In an advantageous development of the device according to the invention, the control device is configured to generate and/or receive a correction signal which is representative of an adjustment correction of the orientation and/or position of the support and clamping elements and, on the basis of the correction signal by bringing about a corresponding actuation of the actuators, to bring about an adjustment correction of the orientation and/or position of the support and clamping elements. As a result of these measures, it is possible virtually in the manner of a feedback measurement process within the production line in the process to configure a tracking of the dimensions so that deviations can always be compensated for.

Sensor elements can be used as additional and separate means in order to detect the state—that is to say, for example, also the position and/or orientation—of the respective actuators and/or the support and clamping elements.

The device according to the invention for shaping a metal sheet has been found to be particularly advantageous if, according to an advantageous embodiment, the control device is configured for cooperation with the actuators and to detect a respective actual orientation and/or actual position of the support and clamping elements. The detection of the actual orientation and/or actual position can be carried out by use of sensors which are integrated in the actuators and/or by way of a control which is provided for each actuator, for example, a step motor or a pneumatic cylinder.

A particularly reliable form of the subsequent adjustment is achieved if the control device is operated in the manner of a control loop.

According to another advantageous development of the device according to the invention for shaping a metal sheet, the control device is configured to compare a respective actual orientation and/or actual position of the support and clamping elements with a respective desired orientation and/or desired position of the support and clamping elements and, based on a result of the comparison, to generate a correction signal which is representative of an adjustment correction of the orientation and/or position of the support and clamping elements. The correction signal can consequently form the basis for a sub sequent adjustment.

According to another aspect of the present invention, a method for shaping a metal sheet which, in particular, uses the device according to the invention for shaping a metal sheet, is also provided.

In the method according to the invention for shaping a metal sheet, the metal sheet is shaped by clamping with mechanical contact a plurality of support and clamping elements with the metal sheet by use of retention members, orientation and/or positioning of the support and clamping elements. In this instance, for an adjustment correction, the orientation and/or position of the support and clamping elements are controlled according to the invention.

In an advantageous embodiment of the method according to the invention for shaping a metal sheet, a correction signal which is representative of an adjustment correction of the orientation and/or position of the support and clamping elements is generated and/or received. Based on the correction signal, an adjustment correction of the orientation and/or position of the support and clamping elements is brought about, in particular by actuating actuators.

An increased degree of reliability is brought about if, according to another embodiment of the method according to the invention, a respective actual orientation and/or actual position of the support and clamping elements is/are detected. This can be carried out in particular by means of correspondingly configured actuators.

In the context of the current production process, it is possible according to the invention to constantly monitor the quality of a product which is intended to be produced and to take corresponding measures for compliance with dimensions.

According to a particularly advantageous embodiment of the method according to the invention for shaping a metal sheet, a respective actual orientation and/or actual position of the support and clamping elements is compared with a respective desired orientation and/or desired position of the support and clamping elements. On the basis of a result of the comparison, a correction signal which is representative of an adjustment correction of the orientation and/or position of the support and clamping elements is generated. This correction signal can then be taken as a basis for the subsequent adjustment in the context of a subsequent correction.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
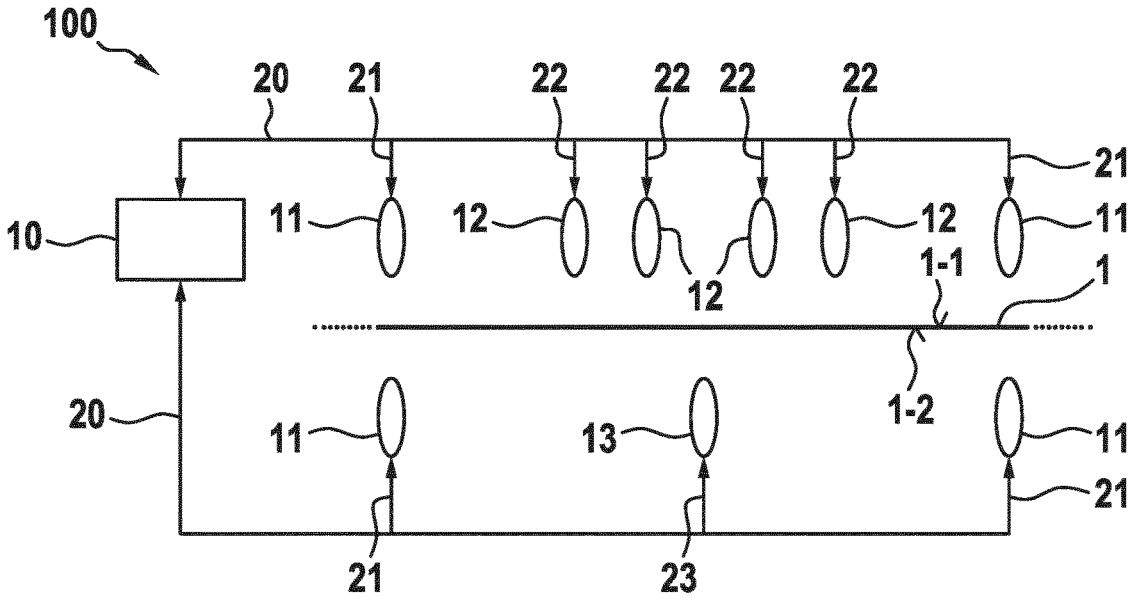
FIGS. 1 to 4 are schematic side views of an embodiment of the device according to the invention for shaping a metal sheet in different operating states, which correspond to different phases of an embodiment of the method according to the invention for shaping a metal sheet.

With reference to FIGS. 1 to 4, embodiments of the invention will be described in detail below. Elements and components which are identical and equivalent and which have an identical or equivalent action are provided with the same reference numerals. The detailed description of the elements and components described is not reproduced each time they occur.

The features and additional properties set out may be separated from each other in any form and freely combined with each other without departing from the central notion of the invention.

FIG. 1 shows an embodiment of the device 100 for shaping a metal sheet 1 as a schematic side view in a first operating state.

The device 100 for shaping a metal sheet according to FIG. 1 includes a plurality of support and clamping elements 11, 12 and 13 which can be adjusted and adapted by way of actuators 21, 22 and 23 in terms of the position and/or orientation thereof with respect to a metal sheet 1 which is intended to be shaped.

The actuators 21, 22 and 23 are connected by a control line 20 to a control device 10 of the device 100. The control line 20 may also be understood to be a detection and control line 20 since it may also be configured to provide from the individual actuators 21, 22 and 23 and the support and clamping elements 11, 12 and 13 connected thereto a feedback to the control device 10 of the device 100 for evaluating and assessing an actual state of the metal sheet 1 and/or the arrangement comprising the actuators 21, 22 and 23 and the support and clamping elements 11, 12 and 13.

The metal sheet 1 has an upper side 1-1 and a lower side 1-2 and is arranged in the schematic illustration according to FIG. 1 so as to extend in a plane perpendicular to the drawing plane.

In the state according to FIG. 1, all of the actuators 21, 22 and 23 are arranged in an idle or starting position. Therefore, all the support and clamping elements 11, 12 and 13 are spatially spaced apart from the upper side 1-1 and the lower side 1-2 of the metal sheet 1 and do not touch the metal sheet 1.

Figure 2:
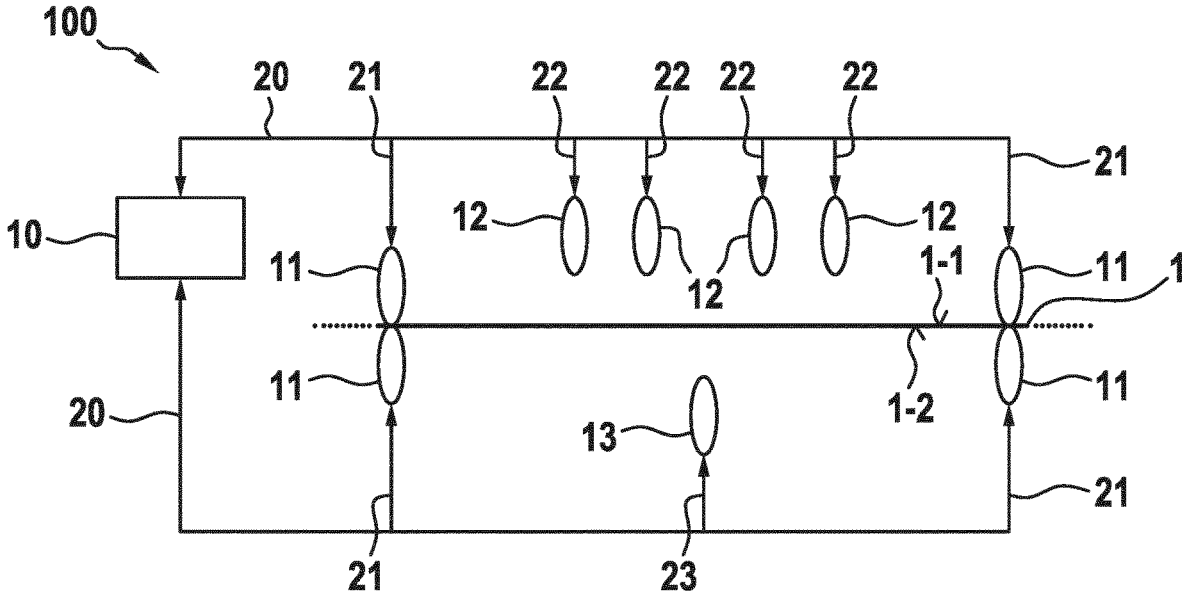

During transition to the state illustrated in FIG. 2, the external actuators 21 are activated so that the first support and clamping elements 11 are moved toward the upper side 1-1 or the lower side 1-2 of the metal sheet 1, touch it mechanically, and clamp and fix it between them. In this manner, the portion of the metal sheet 1 arranged between the first support and clamping elements 11 is fixed in the manner of a clamping frame, this is required for the following shaping processes.

Figure 3:
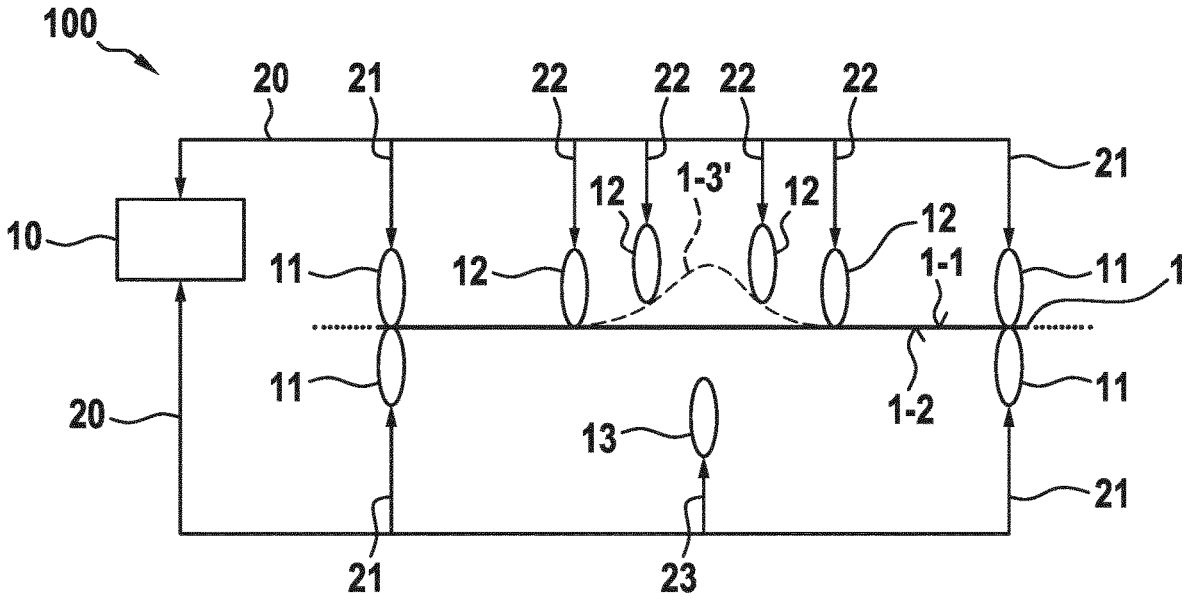

During transition to the intermediate state illustrated in the Figures, second support and clamping elements 12 are moved toward the upper side 1-1 of the metal sheet 1 in such a manner that they follow in the manner of a support point distribution approximately a shape 1-3' desired for the metal sheet 1. This desired shape 1-3' for the metal sheet 1, which is intended to be achieved by the shaping process by the device 100 using the correct method, is illustrated in FIG. 3 with broken lines.

During transition to the intermediate state illustrated in FIG. 4, a third support and clamping element 13 is moved from below toward the lower side 1-2 of the metal sheet 1 in such a manner that the third support and clamping element 13 touches the lower side 1-2 of the metal sheet 1 and moves from the idle position designated 1' in FIG. 4 upward in the direction toward the second support and clamping elements 12 in order to produce an actual shape 1-3 of the metal sheet 1 which follows or corresponds to the path of the contact locations with the second and third support and clamping elements 12 and 13.

Figure 4:
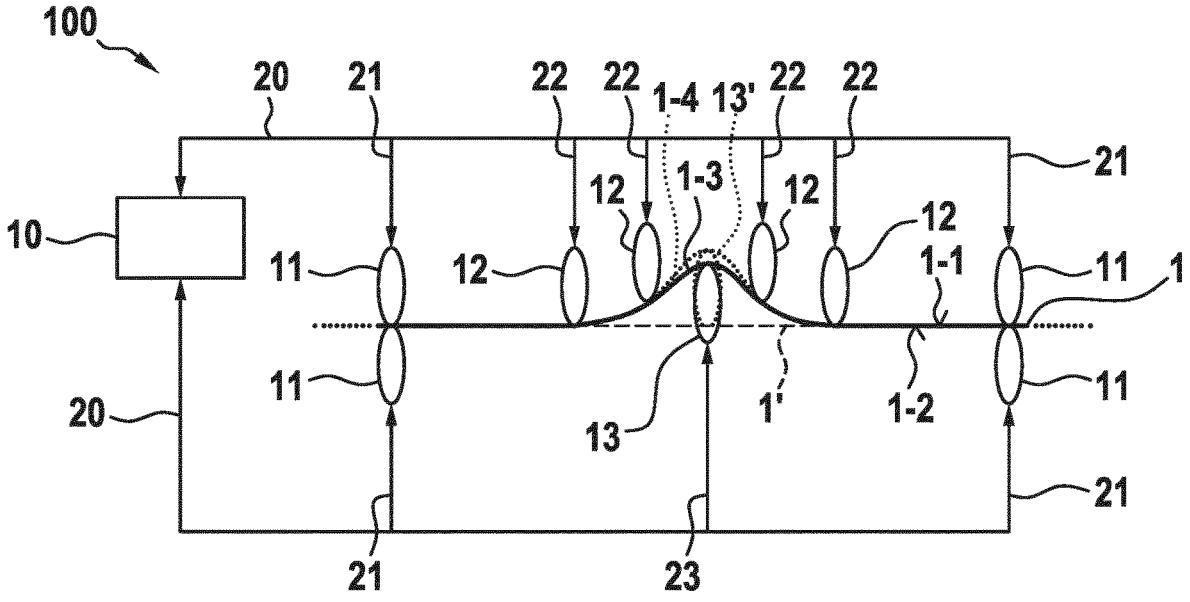

If a comparison of the actual shape 1-3 of the metal sheet 1 results in a deviation being established, for example, in comparison with a desired shape 1-4 of the metal sheet 1, it is thus possible during the production process, for example, during the production of subsequent components, for the control of the third actuator 23 by the control device 10 via the control line 20 to result, by changing the actuation of the third actuator 23, in the third support and clamping element 13 being displaced into the position designated 13' in FIG. 4 so that the actual shape 1-3 approximates as well as possible the desired shape 1-4 of the metal sheet 1 in the following production process.

These features and other features and properties of the present invention are further explained with reference to the following statements.

Currently, the receiving and clamping situations which are found primarily in the main lines are adjusted manually by the persons responsible for dimensions and methodologists to process-optimized dimension compliance. Any changes should accordingly be documented in order to make the effects comprehensible.

This is disadvantageous since, inter alia, no derivative-specific geometry adaptation is possible and a high level of complexity during the establishment and documentation of the tool adjustment is required since both the product and tool tolerances have to be detected and established in a station-specific manner.

As a result of the use of flexible floor clamping technology or clamping technology in general, which can be freely programmed and/or adjusted in several directions, it is possible to adjust geometry-determining dimensions within a production system continuously by use of software, for example, by use of an adapted input mask. This is also possible in a derivative-specific or type-specific manner.

The complex manual adaptation to the tools which may also lead to errors between the different derivatives is omitted.

As a result of the optionally generally continuous individual adaptation which can be selected specifically, the overall modification complexity is reduced and automatically documented so as to be able to be understood. The previously conventional shim records, which are generally kept manually when shim plates are used, is consequently virtually digitized.

LIST OF REFERENCE NUMERALS

1 Metal sheet
1-1 Upper side
1-2 Lower side
1-3 Actual shape
1-3' Intended shape
1-4 Desired shape
10 Control device
11 Support and clamping element
12 Support and clamping element
13 Support and clamping element
20 Control and detection line
21 Actuator
22 Actuator
23 Actuator
100 Device The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for shaping a metal sheet, comprising:
a plurality of clamps which are configured to
assume various positions and orientations by being configured to move at least linearly,
cooperate with one another so as to support and clamp the metal sheet for a shaping operation by mechanically contacting the metal sheet, and
orient and position the metal sheet,
a plurality of actuators which are configured to orientate and position the plurality of clamps;
a controller for the plurality of actuators, wherein
the controller is configured to:
detect a respective actual orientation and actual position of the clamps,
control the plurality of actuators so as to effect an adjustment correction of the orientation and position of the plurality of clamps,
generate the adjustment correction while simultaneously storing adjustment correction measures,
generate and receive a correction signal which is representative of the adjustment correction of the orientation and position of the plurality of clamps, and
based on the correction signal, by bringing about a corresponding actuation of the actuators, bring about the adjustment correction of the orientation and position of the plurality of clamps; and
at least one sensor element configured as an additional and separate means to detect the position and orientation of the clamps, wherein
only actuators that are upstream and downstream of a region to be shaped are actuated prior to the shaping of the metal sheet.

2. The device as claimed in claim 1, wherein the controller is further configured to:
compare the respective actual orientation and the actual position of the plurality of clamps with a respective desired orientation and desired position of the plurality of clamps, and
based on a result of the comparison, generate the correction signal which is representative of the adjustment correction of the orientation and position of the plurality of clamps.

3. A method for shaping a metal sheet, the method comprising the acts of:
shaping the metal sheet by clamping the metal sheet with a plurality of clamps configured to
assume various positions and orientations by being configured to move at least linearly,
cooperate with one another so as to clamp the metal sheet by mechanically contacting the metal sheet, and
support, orient, and position the metal sheet;
detecting an actual orientation and actual position of the clamps using a controller and separately using at least one sensor element,
generating adjustment correction measures while simultaneously storing the adjustment correction measures;
generating and receiving a correction signal which is representative of the adjustment correction measures of an orientation and position of the plurality of clamps and
based on the correction signal, by bringing about a corresponding actuation of actuators, bring about an adjustment correction of the orientation and position of the plurality of clamps, wherein
only actuators that are upstream and downstream of a region to be shaped are actuated prior to the shaping of the metal sheet.

4. The method as claimed in claim 3, further comprising:
comparing the respective actual orientation and the actual position of the plurality of clamps with a respective desired orientation and desired position of the plurality of clamps, and
generating, based on a result of the comparison, the correction signal, which is representative of the adjustment correction measures of the orientation and position of the plurality of clamps.

* * * * *